US010034509B2

(12) United States Patent
Pruett et al.

(10) Patent No.: US 10,034,509 B2
(45) Date of Patent: Jul. 31, 2018

(54) TASSEL SECURING GRADUATE CAP DEVICE

(71) Applicants: Josh Pruett, Sioux Falls, SD (US); Almir Krdzalic, Sioux Falls, SD (US)

(72) Inventors: Josh Pruett, Sioux Falls, SD (US); Almir Krdzalic, Sioux Falls, SD (US)

( * ) Notice: Subject to any disclaimer, the term of this patent is extended or adjusted under 35 U.S.C. 154(b) by 197 days.

(21) Appl. No.: 15/214,644

(22) Filed: Jul. 20, 2016

(65) Prior Publication Data

US 2018/0020758 A1 Jan. 25, 2018

(51) Int. Cl.
*A42B 1/00* (2006.01)
*A42B 1/24* (2006.01)
*A42B 1/02* (2006.01)

(52) U.S. Cl.
CPC ..... *A42B 1/24* (2013.01); *A42B 1/004* (2013.01); *A42B 1/02* (2013.01)

(58) Field of Classification Search
CPC ..... A42B 1/24; A42B 1/004; A42B 1/02
USPC ..... 2/171.01
See application file for complete search history.

(56) References Cited

U.S. PATENT DOCUMENTS 364,129 A * 5/1887 Plato ..... A42B 1/02 2/175.5
1,538,072 A * 5/1925 Tompkins ..... A42B 1/02 2/175.9
2,462,679 A * 2/1949 Rosenau ..... A42B 1/004 2/171
4,914,755 A * 4/1990 Motley ..... A42B 1/004 2/200.2
5,621,920 A 4/1997 Gorsuch et al.
5,862,523 A 1/1999 Proctor
5,967,161 A * 10/1999 Neal ..... A42B 1/004 135/19.5
D435,330 S * 12/2000 Soergel ..... D2/866
8,950,016 B2 2/2015 Depplito
9,089,181 B1 * 7/2015 Sigle ..... A42B 1/241
9,179,720 B1 * 11/2015 Bonadio, Jr. ..... A42B 1/062
9,241,526 B2 1/2016 Goldberg
2002/0020087 A1 * 2/2002 Griffith ..... G09F 1/10 40/124.4
2003/0079274 A1 * 5/2003 Noble ..... A42B 1/004 2/175.5
2004/0026468 A1 2/2004 Lawrence
2013/0175187 A1 7/2013 McCleary

FOREIGN PATENT DOCUMENTS

JP 3088516 9/2002

* cited by examiner

*Primary Examiner* — Sally Haden

(57) ABSTRACT

A tassel securing graduate cap device inhibits undesired movement or positioning of a tassel while wearing a graduation cap. The device includes a board coupled to a skull cap. The board has a perimeter edge. A line has a first end coupled to the board and a second end coupled to a tassel such that the line extends over the perimeter edge of the board. A slot extends into the perimeter edge of the board. The line is positionable in the slot wherein the slot inhibits sliding of the line along the perimeter edge of the board.

13 Claims, 1 Drawing Sheet

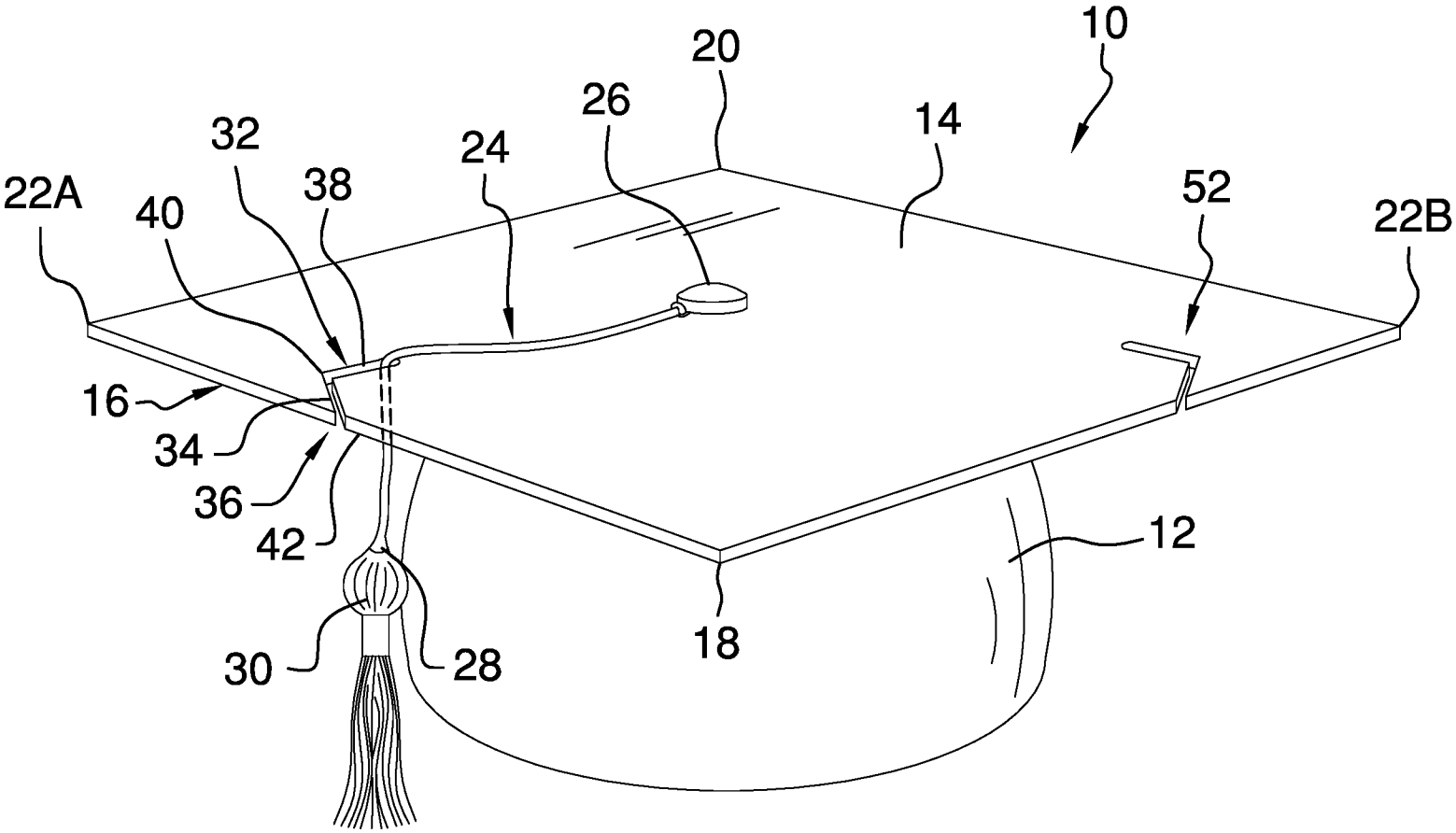
10
22B
52
14
20
26
24
38
32
40
22A
16
34
36
42
12
18
28
30

TASSEL SECURING GRADUATE CAP DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to cap devices and more particularly pertains to a new cap device for inhibiting undesired movement or positioning of a tassel while wearing a graduation cap.

BRIEF SUMMARY OF THE INVENTION

An embodiment of the disclosure meets the needs presented above by generally comprising a board coupled to a skull cap. The board has a perimeter edge. A line has a first end coupled to the board and a second end coupled to a tassel such that the line extends over the perimeter edge of the board. A slot extends into the perimeter edge of the board. The line is positionable in the slot wherein the slot inhibits sliding of the line along the perimeter edge of the board.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 1 is a top front side perspective view of a tassel securing graduate cap device according to an embodiment of the disclosure.

DETAILED DESCRIPTION OF THE INVENTION

With reference now to the drawings, and in particular to FIG. 1 thereof, a new cap device embodying the principles and concepts of an embodiment of the disclosure and generally designated by the reference numeral 10 will be described.

As best illustrated in FIG. 1, the tassel securing graduate cap device 10 generally comprises a skull cap 12 and a board 14 coupled to the skull cap 12. The board 14 has a perimeter edge 16. The board 14 is square wherein the perimeter edge 16 of the board 14 defines a front point 18, a rear point 20, and a pair of lateral points 22A,22B. A line 24 has a first end 26 coupled to the board 14 and a second end 28 coupled to a tassel 30 such that the line 24 extends over the perimeter edge 16 of the board 14.

A slot 32 extends into the perimeter edge 16 of the board 14. The line 24 is positionable in the slot 32 wherein the slot 32 inhibits sliding of the line 24 along the perimeter edge 16 of the board 14. The slot 32 has a first section 34 extending inwardly from the perimeter edge 16 of the board 14. The first section 34 forms an acute angle 36 with the perimeter edge 16 of the board 14. The slot 32 has a second section 38 extending into the board 14 from a distal end 40 of the first section 34 relative to the perimeter edge 16 of the board 14. Each of the first section 34 and the second section 38 of the slot 32 is straight. The slot 32 extends into the perimeter edge 16 along a side 42 of the perimeter edge 16 between the front point 18 and one of the lateral points 22A. The first section 34 of the slot 32 extends into the perimeter edge 16 of the board 14 such that the first section 34 extends towards the one of the lateral points 22A and away from the front point 18. The slot 32 is a first slot extending into the perimeter edge 16 of the board 14. A second slot 52 extends into the perimeter edge 16 of the board 14 between the front point 18 and a second one of the lateral points 22B. The second slot 52 is a mirror image of the first slot 32 such that the first slot 32 and the second slot 52 are symmetrical about a center line extending through the front point 18 and the rear point 20.

In use, the first end 26 of the line 24 is secured to the board 14 in a conventional manner. The line 24 is then inserted into a desired one of the first slot 32 and the second slot 52 such that the tassel 30 and line 24 are prevented from sliding along the perimeter edge 16 of the board 14. This substantially secures the tassel 30 to inhibit the tassel 30 from blocking view of the face of the wearer during pictures and generally reduces movement of the tassel 30 in a manner which may be distracting or bothersome. When desired, such as may be considered traditional, the line 24 may be moved from one to the other of the first slot 32 and the second slot 52 after receiving a diploma.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A tassel securing graduation cap device comprising:

a skull cap;

a board coupled to said skull cap, said board having a perimeter edge, said board being square, wherein said perimeter edge of said board defines a front point, a rear point, a first lateral point, and a second lateral point;

a tassel;

a line having a first end coupled to said board and a second end coupled to said tassel such that said line extends over said perimeter edge of said board; and a slot, said slot extending into said perimeter edge of said board, said line being positionable in said slot wherein said slot inhibits sliding of said line along said perimeter edge of said board.

2. The device of claim 1, further comprising said slot having a first section extending inwardly from said perimeter edge of said board, said first section forming an acute angle with said perimeter edge of said board.

3. The device of claim 2, further comprising said slot having a second section extending into said board from a distal end of said first section relative to said perimeter edge of said board.

4. The device of claim 3, further comprising each of said first section and said second section of said slot being straight.

5. The device of claim 4, further comprising: said slot being a first slot extending into said perimeter edge of said board; and a second slot, said second slot extending into said perimeter edge of said board between said front point and said second lateral point.

6. The device of claim 5, further comprising said second slot being structured such that first slot and said second slot are symmetrical about a center line extending through said front point and said rear point.

7. The device of claim 3, further comprising: said slot being a first slot extending into said perimeter edge of said board; and a second slot, said second slot extending into said perimeter edge of said board between said front point and said second lateral point.

8. The device of claim 7, further comprising said second slot being structured such that first slot and said second slot are symmetrical about a center line extending through said front point and said rear point.

9. The device of claim 1, further comprising said slot extending into said perimeter edge along a side of said perimeter edge between said front point and said first lateral point.

10. The device of claim 1, further comprising said slot having a first section extending inwardly from said perimeter edge of said board, said first section forming an acute angle with said perimeter edge of said board, said slot having a second section extending into said board from a distal end of said first section relative to said perimeter edge of said board, and said first section of said slot extending into said perimeter edge of said board such that said first section extends towards said first lateral point and away from said front point.

11. The device of claim 1, further comprising: said slot being a first slot extending into said perimeter edge of said board; and a second slot, said second slot extending into said perimeter edge of said board between said front point and said second lateral point.

12. The device of claim 11, further comprising said second slot being structured such that first slot and said second slot are symmetrical about a center line extending through said front point and said rear point.

13. A tassel securing graduation cap device comprising: a skull cap; a board coupled to said skull cap, said board having a perimeter edge, said board being square wherein said perimeter edge of said board defines a front point, a rear point, a first lateral point, and a second lateral point; a tassel; a line having a first end coupled to said board and a second end coupled to said tassel such that said line extends over said perimeter edge of said board; a slot, said slot extending into said perimeter edge of said board, said line being positionable in said slot wherein said slot inhibits sliding of said line along said perimeter edge of said board, said slot having a first section extending inwardly from said perimeter edge of said board, said first section forming an acute angle with said perimeter edge of said board, said slot having a second section extending into said board from a distal end of said first section relative to said perimeter edge of said board, each of said first section and said second section of said slot being straight, said slot extending into said perimeter edge along a side of said perimeter edge between said front point and said first lateral point, said first section of said slot extending into said perimeter edge of said board such that said first section extends towards said first lateral point and away from said front point, said slot being a first slot extending into said perimeter edge of said board; and a second slot, said second slot extending into said perimeter edge of said board between said front point and said second lateral point, said second slot being structured such that first slot and said second slot are symmetrical about a center line extending through said front point and said rear point.

* * * * *